US011234887B2

(12) United States Patent
Bombard

(10) Patent No.: US 11,234,887 B2
(45) Date of Patent: Feb. 1, 2022

(54) CONTINUOUS PASSIVE MOTION DEVICE

(71) Applicant: David L. Bombard, Edwards, CO (US)

(72) Inventor: David L. Bombard, Edwards, CO (US)

( * ) Notice: Subject to any disclaimer, the term of this patent is extended or adjusted under 35 U.S.C. 154(b) by 871 days.

(21) Appl. No.: 15/904,391

(22) Filed: Feb. 25, 2018

(65) Prior Publication Data

US 2018/0177662 A1 Jun. 28, 2018

Related U.S. Application Data

(63) Continuation of application No. 13/879,946, filed as application No. PCT/US2011/063045 on Dec. 2, 2011, now Pat. No. 9,901,505.

(60) Provisional application No. 61/419,428, filed on Dec. 3, 2010.

(51) Int. Cl.

| | |
|---|---|
| ***A61H 1/02*** | (2006.01) |
| ***A61H 1/00*** | (2006.01) |
| ***A61H 9/00*** | (2006.01) |

(52) U.S. Cl.

CPC ..... *A61H 1/006* (2013.01); *A61H 1/0244* (2013.01); *A61H 9/0078* (2013.01); *A61H 2201/1215* (2013.01); *A61H 2201/1642* (2013.01); *A61H 2201/1666* (2013.01); *A61H 2201/1671* (2013.01); *A61H 2201/1676* (2013.01); *A61H 2201/5007* (2013.01); *A61H 2201/5012* (2013.01); *A61H 2201/5015* (2013.01); *A61H 2201/5035* (2013.01); *A61H 2201/5046* (2013.01); *A61H 2201/5058* (2013.01)

(58) Field of Classification Search

CPC ..... A61H 1/0244; A61H 2001/0203; A61H 2001/0207; A61H 2201/1215; A61H 2201/1642; A61H 2201/1666; A61H 2201/1671

See application file for complete search history.

(56) References Cited

U.S. PATENT DOCUMENTS

| | | | | |
|---|---|---|---|---|
| 5,211,161 A * | 5/1993 | Stef | A61H 1/0266 601/31 |
| 5,860,941 A * | 1/1999 | Saringer | A61H 1/0214 482/4 |
| 6,342,042 B1 * | 1/2002 | Martin | A61H 1/0237 601/84 |
| 6,749,539 B2 * | 6/2004 | Hsieh | A61H 1/0237 482/51 |

(Continued)

*Primary Examiner* — Timothy A Stanis

(74) *Attorney, Agent, or Firm* — James Conte; Conte Law Group

(57) ABSTRACT

The present invention is directed toward a device for circumduction of a limb having a base, a vertical support operably coupled to and extending away from the base, a rotary member operably connected to the vertical support, a limb support member operably connected to the rotary member, and a motor drivingly engaged with the rotary member. The vertical support may be a rigid plate member, bracket, or frame. The bracket and/or frame may include at least one vertical member and at least one horizontal member. The rotary member is operably connected to the vertical support such that rotary member is free to rotate. Limb support member receives and supports the limb to be treated and is operably coupled to rotary member at a radial distance from a center of rotation thereby resulting in a circular motion of a limb when the motor is operated.

12 Claims, 7 Drawing Sheets

(56) References Cited

U.S. PATENT DOCUMENTS

| | | | | |
|---|---|---|---|---|
| 6,932,778 | B2 * | 8/2005 | Hirt | A61H 1/0237 601/101 |
| 7,854,709 | B2 * | 12/2010 | Neff | A61H 23/0263 601/29 |
| 2002/0087104 | A1 * | 7/2002 | Huang | A63B 22/0056 601/33 |
| 2003/0045818 | A1 * | 3/2003 | Huang | A61H 1/0237 601/97 |
| 2004/0243029 | A1 * | 12/2004 | Shimizu | A61H 7/007 601/90 |
| 2006/0116619 | A1 * | 6/2006 | Weinstein | A61H 9/0078 602/32 |

* cited by examiner

CONTINUOUS PASSIVE MOTION DEVICE

CROSS REFERENCE TO RELATED APPLICATIONS

The present application is a continuation application of U.S. application Ser. No. 13/879,946 filed Apr. 17, 2013 which is itself a 371 application of international application 2011063045 filed Dec. 2, 2011 which itself claims the benefit of U.S. provisional application 61/419,428 filed Dec. 3, 2010.

BACKGROUND

Continuous passive motion is used to reduce pain, help joint flexibility and generally reduce recovery time from many orthopedic operations, particularly of the knee and hip. A circular motion (circumduction) of the head of the femur relative to the acetabulum (pelvis) through a prescribed range without muscle contractions provides for desirable continuous passive motion of a hip joint. Other passive motions (e.g. extension, flexion, abduction, adduction, internal rotation, external rotation) of the femur relative to the acetabulum may prove to be beneficial as more research and clinical data is collected. Physical or occupational therapists or nurses perform circumduction of the hip joint by manual manipulation. The size of the patient can make the manual technique difficult to perform and/or maintain for an extended period of time. Circumduction currently performed by a therapist or nurse is generally only sustainable for 10-30 minutes each session. More often than not, patients are only able to receive a maximum of one session per day during extended out-patient recovery. Current clinical data suggests, however, that at least two hours of continuous passive motion (circumduction) of the hip joint is required for maximum benefit and shorter recovery and rehabilitation times.

There are presently continuous passive motion machines designed to be used for therapeutic treatment of the knee, ankle, wrist, and shoulder. Because of the benefits of prolonged mechanized continuous passive motion, current therapies for the hip joint often use a machine designed for the knee. A machine designed for the knee does not confer the maximum targeted benefit for a hip joint. The knee device for instance performs flexion and extension of the leg and femur relative to the pelvis. Flexion and extension of the leg, while somewhat beneficial to recovery of the hip joint, does not confer the identical benefits to the hip joint as circumduction.

SUMMARY

The present invention is directed toward a device for circumduction of a limb comprising a base, a vertical support operably coupled to and extending away from the base, a rotary member operably connected to the vertical support, a limb support member operably connected to the rotary member, and a motor operable to cause the rotation of the rotary ember thereby causing circumduction of a limb supported by the limb support member.

The base is configured to provide a moveable footprint and may be portable throughout a home or clinical setting. One embodiment includes the base being configured to position the device on a bed or couch. The vertical support is coupled to the base and generally comprises a rigid plate member, a bracket, or a frame. The bracket and/or frame may include at least one vertical member and at least one horizontal member. The rotary member is operably connected to the vertical support such that the rotary member may rotate. One embodiment includes rotary member being operably connected to vertical support by an axle that is operably connected to the vertical support and wherein the axle is configured to rotate about its longitudinal axis. The rotary member is operably connected to a first end of the axle and the second end and/or the mid-section of the axle is operably connected to the vertical support such that rotary member and the axle are free to rotate about the axle's longitudinal axis. One embodiment includes a rotary member being a substantially circular disk and another embodiment includes a rotary member being a radially extending arm. In another embodiment, the rotary motion can be attained through the combined, coordinated movement of two linear motors. This embodiment is also able to create more complex passive motions at the hip joint, such as combinations of circumduction, extension, flexion, abduction, and adduction. These more complex motions may prove to be clinically beneficial in the healing and therapy of the hip joint.

The limb support member is operably connected to the rotary member and may be removable. The limb support member is configured to receive and support at least a portion of the limb being treated. One embodiment includes a "cradle" type limb support member that receives a patient's foot and a portion of the lower leg. Another limb support member may be a leg brace that is configured to operably connect to the rotary member. The connection between the limb support member and the rotary member may be configured such that the user's limb is substantially maintained in a neutral position so that little to no torque or internal or external rotation is applied to the limb while the rotary member rotates.

The present invention is also advantageous because the rotary member may be configured such that the limb support member may be operably connected to the rotary member at a plurality of radial distances from a center of said rotary member. This allows the gradual increase in the radius or pattern of circumduction as the physical therapy progresses and as greater freedom of movement is achieved. In one embodiment, a multi-direction A/C induction motor is used to rotate the axle and rotary member. Since the limb support is positioned at an offset radial distance from the point of rotation of the rotary member, the device moves the limb in a substantially circular motion thereby resulting in circumduction of the limb. The motor, however, may be a D/C motor or any other motor type now known or hereafter developed. The operation of the motor may be controlled with a control panel and/or wired or wireless remote control unit. The motor thereby allows a user to provide continuous or interval circumduction for hours at a time.

The present invention overcomes the shortcomings in the prior art because the present invention is a therapeutic device that performs circumduction of a limb. Further, a patient may use this device in the comfort of their home or in a clinical setting and may operate the motor to provide hours of treatment a day if desired, including overnight while sleeping. Moreover, increasing the duration of treatment merely requires the cost of additional electricity to operate the motor, shortens the recovery time, and does not require additional time of doctors or physical therapists thereby resulting in an overall efficiency and reducing the overall treatment and therapy costs associated with certain limb injuries.

Other aspects and advantages of the present invention will be apparent from the following detailed description of the preferred embodiments and the accompanying drawing figures.

BRIEF DESCRIPTION OF DRAWINGS

Further features of the present invention will become apparent to those skilled in the art to which the present invention relates from reading the following description with reference to the accompanying drawings, in which:

FIG. 8 is a cross-section view of a limb support member similar to that shown in FIG. 7 along line 8-8 in accordance with one embodiment of the present invention; wherein FIG. 8 shows a coupling assembly at the thigh as opposed to at the foot as shown in FIG. 7;

DETAILED DESCRIPTION

Figure 1:
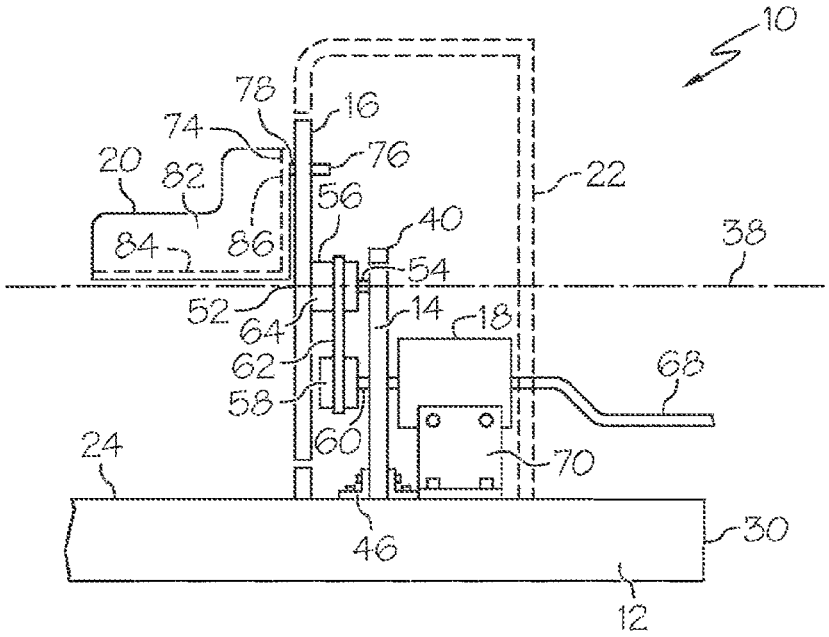
FIG. 1 is a side view of a continuous passive motion device in accordance with one embodiment of the present invention.

The following description of the invention illustrates specific embodiments in which the invention can be practiced. The embodiments are intended to describe aspects of the invention in sufficient detail to enable those skilled in the art to practice the invention. Other embodiments can be utilized and changes can be made without departing from the scope of the present invention, U.S. application Ser. No. 13/879,946, filed Apr. 17, 2013 is incorporated in its entirety herein by this reference.

The present invention is directed toward a continuous passive motion device 10 that performs limb circumduction. Now turning to FIG. 1, the continuous passive motion device 10 of the present invention includes a base 12, a vertical support 14, a rotary motion element 16, a motor 18, and a limb support 20. Continuous passive motion device 10 may also include a housing 22 that encloses the mechanical components of the present invention.

Figure 2:
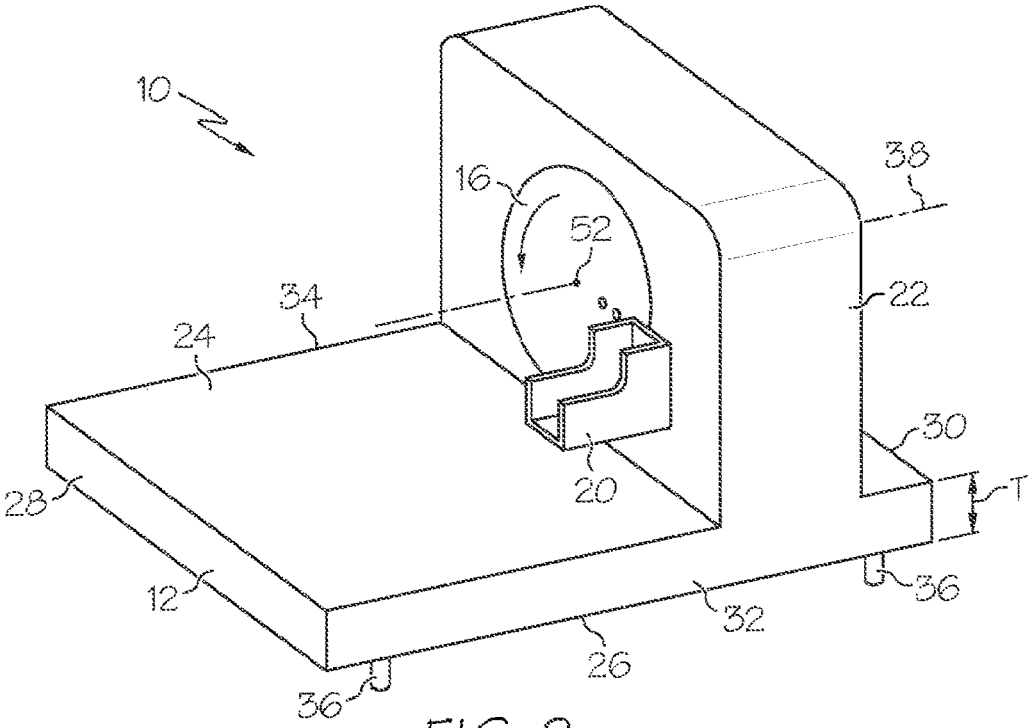
FIG. 2 is a top perspective view of a continuous passive motion device in accordance with one embodiment of the present invention.

As shown in FIG. 2, base 12 may be a substantially rigid member having a substantially rectangular shape. Base 12 includes a top 24, a bottom 26, a front 28, a back 30, a first side 32, a second side 34 and a thickness "T". Top 24, bottom 26, front 28, back 30, first side 32 and second side 34 may be planar, curved, beveled, or any combination thereof. Thickness "T" may be any thickness known in the art to adequately support the elements of continuous passive motion device 10. An embodiment includes thickness "T" being in a range from one-eighth (⅛) inch to twelve (12) inches. One embodiment of base 12 includes a plurality of legs 36 coupled to bottom 26 of base 12. In one embodiment, legs 36 are configured to have an adjustable length. Methods of adjusting legs 36 include a screw-type mechanism, a telescoping leg configured of at least two nesting members, one member configured to slide elative to the other wherein the overall length of the two members may be temporarily fixed by inserting a pin through both members wherein at least one member includes a plurality of guide thru-holes along its length to provide a plurality of overall leg lengths or least one clamping mechanism to fix the length thereof, or any other adjustment mechanism now known or hereafter developed.

A person of skill in the art would readily appreciate that base 12 shall not limited to a rectangular shape, but embodiments of base 12 may be circular, elliptical, triangular, or any other polygon having at least three sides. Base ay be solid stock, a solid unitary piece as shown in FIGS. 1-5, or constructed from a plurality of members. One embodiment of base 12 (not shown) is a frame that is constructed from rigid members operably connected to each other according to known methods and configurations in the art. This embodiment may further include a plurality of panels removably coupled to the frame (not shown). Base 12 may be any material having the rigidity to support the elements of continuous passive motion device 10 including, wood, molded or extruded plastic, steel, iron, carbon-fiber, brass, aluminum, other composite, or any combination thereof.

Figure 5:
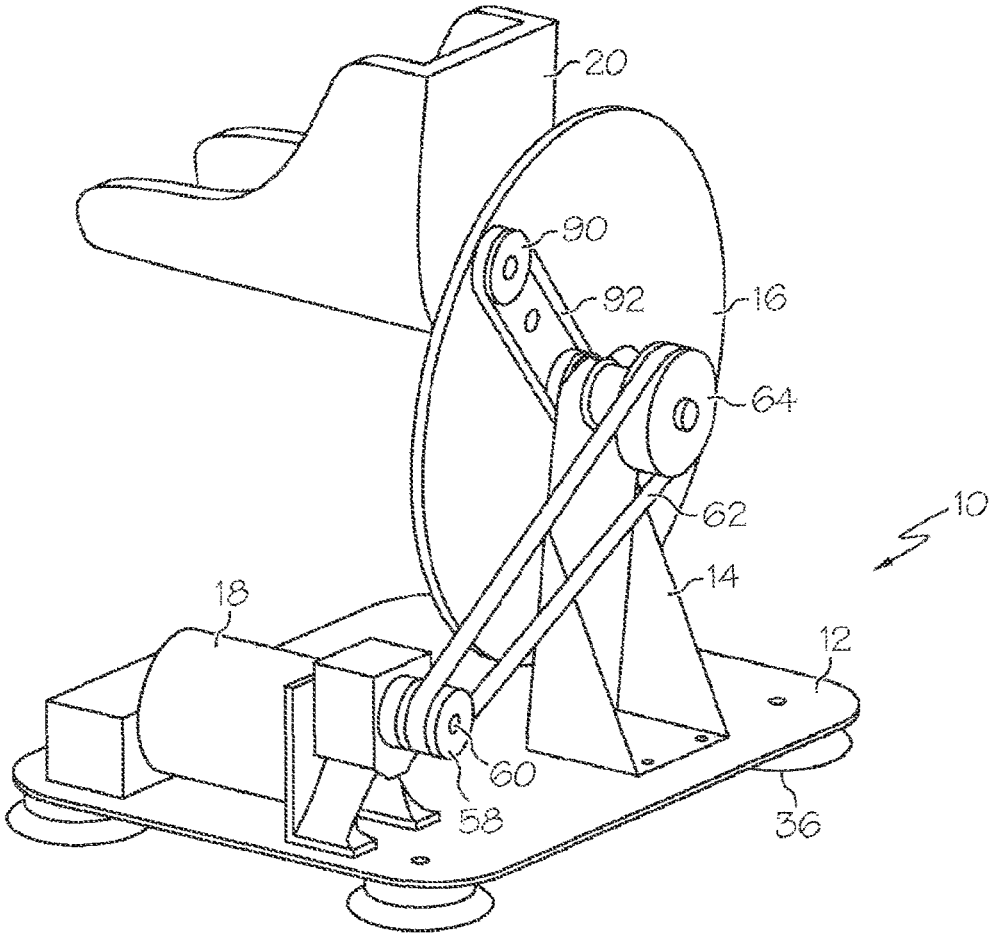
FIG. 5 is a top perspective view of a continuous passive motion device in accordance with one embodiment of the present invention.
Figure 9:
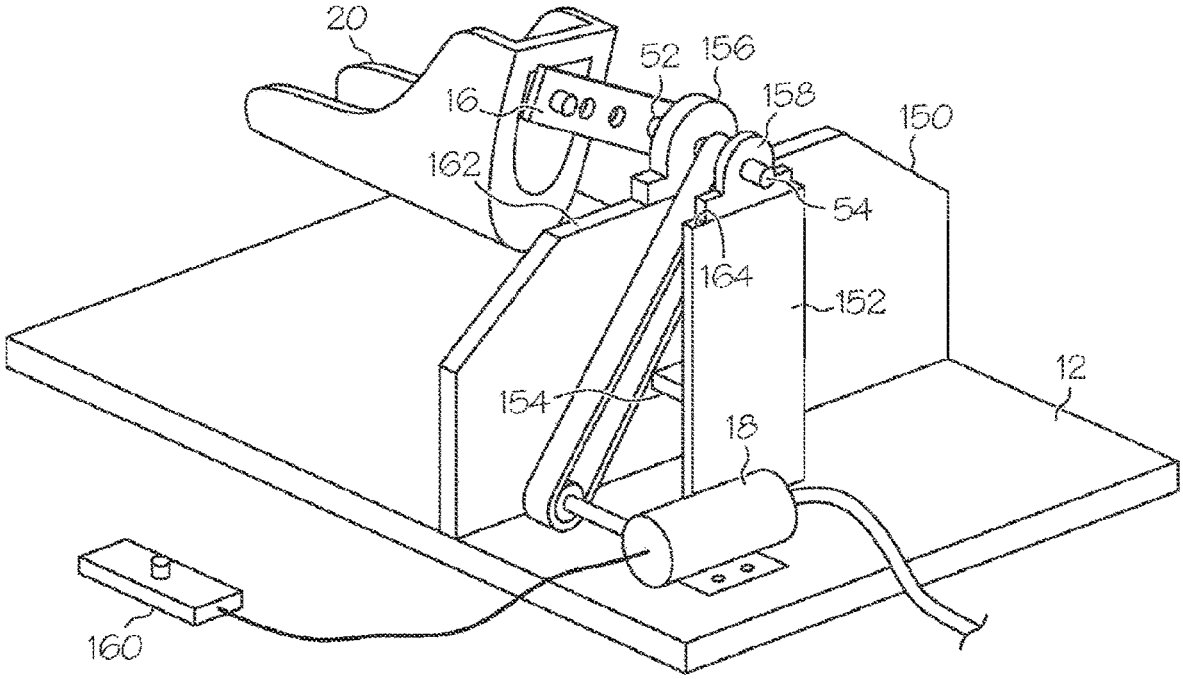
FIG. 9 is a top perspective view of a continuous passive motion device in accordance with one embodiment of the present invention.

As best shown in FIG. 1, vertical support 14 is coupled to top 24 of base 12 and generally supports rotary element 16 away from base 12. Vertical support 14 may be separate from or integral with base 12. Vertical support 14 is configured to allow rotation of rotary element 16 about a rotation axis 38. Vertical support 14 may be an internal support member as shown in FIG. 1, wherein vertical support 14 is configured as an internal frame 40 made of at least one substantially vertical frame member 42 and one substantially horizontal frame member 44. Alternatively, one embodiment may include a vertical support 14 being substantially solid or unitary support member, such as a panel (as shown in FIG. 9), a board, a bracket (as shown in FIG. 5), or housing 22 being configured to support rotary element 6 and allow rotation and operation thereof as described herein.

Vertical support 14 may be constructed of steel, aluminum, extruded or molded composites, wood, carbon-fiber, or other material known in the art having properties sufficient to support the rotary element 16 against translation but allowing for the rotation of rotary element 16. One embodiment includes vertical support 14 being machined from solid stock or molded from a composite material such as polyethylene or other plastic. Vertical support 14 including frame 40 may be constructed using bars, angles, tubes, pipes, channels, or rods. Vertical support 14 may be coupled to base 12 using bracket 46 or other coupling method. Coupling methods used throughout this description shall include any coupling method known in the art including screws, bolts, clamps, welds, pins, nails, compression fittings, or any combination thereof.

Figure 3:
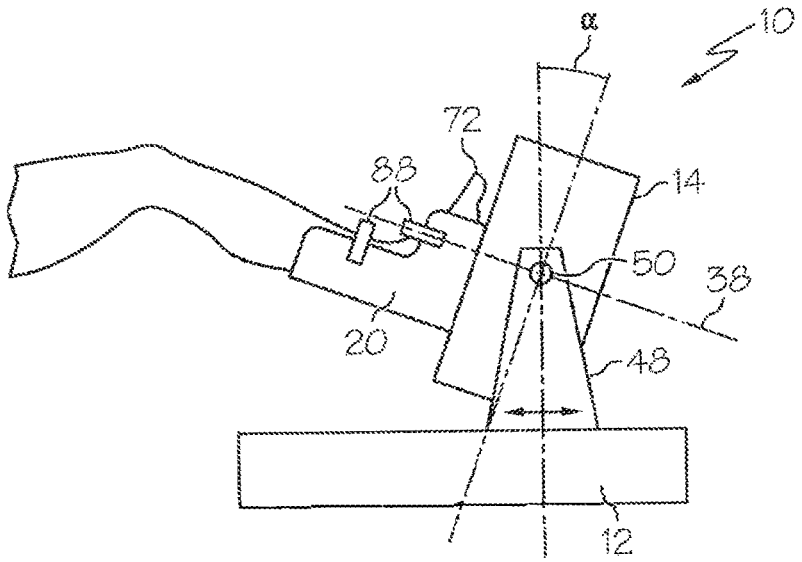
FIG. 3 is a side view of a continuous passive motion device with a limb coupled thereto in accordance with one embodiment of the present invention.

As shown in FIG. 3, one embodiment of the presentation includes rotary element 16 operably coupled to vertical support 14 and vertical support 14 being operably coupled to base 12 by one or more adjustment arms 48. Adjustment arm 48 may be slidingly engaged with base 12 wherein adjustment arm 48 slides substantially linearly along the base 12 in the direction of arrows shown. The position of adjustment arm 48 may be temporarily fixed at one of a plurality of positions along the length of base 12 in preparation for or during use. One embodiment includes adjustment arm 48 driven by a screw-drive or other driver to gradually vary the position of the vertical support 14 and rotary element 16 along the length of base 12 during treatment.

FIG. 3 also shows one embodiment that includes vertical support 14 operably connected to adjustment arm 48 using pivot assembly 50. Pivot assembly 50 may be any pivot mechanism now known or hereafter developed that is configured to allow vertical support 14 and rotary element 16 to rotate about an axis thereby allowing the rotary element 16 to be positioned at an inclination angle a ranging from zero (0) to ninety (90) degrees from vertical. Pivot assembly 50 may also be configured to temporarily fix inclination angle a and the position of vertical support 14 and rotary element 16 with respect to base 12 during treatment. One embodiment of the present invention includes pivot assembly 50 allowing a user to adjust and fix the inclination angle a of vertical support 14 and rotary element 16 in fixed increments. For example, inclination angle a of vertical support 14 and rotary element 16 may be fixed in angular increments of five, ten, fifteen, twenty, thirty, forty-five degrees, or any combination thereof. One embodiment includes pivot mechanism mechanically driven by a motor to gradually vary inclination angle a during treatment.

Embodiments of the present invention may include one or more adjustment arms 48 configured to slidingly connect vertical support 14 and rotary element 16 to base 12 to provide linear adjustment of their position relative to the base 12, one or more adjustment awns 48 that are configured to adjust inclination angle a, or one or more adjustment arms 48 that are configured to provide a combination of linear and angular adjustment.

Now turning back to FIG. 1, an embodiment of the present invention is shown wherein rotary element 16 is a substantially rigid disc 16 that is coupled to a first end 56 of axle 54 wherein axle 54 is operably connected to vertical support 14 such that axle 54 and rotary element 16 are free to rotate about axis 38. In one embodiment, rotary element 16 is a rigid bar (as shown in FIG. 9) extending radially from a point of rotation 52. Rotary element 16 may have a radius of one (1) to eighteen (18) inches.

Rotary element 16 is generally driven by motor 18. One embodiment includes rotary element 16 rotating upon axle 54 about axis 38 as shown in FIG. 1. As such, rotary element 16 is thereby rotatably driven about point of rotation 52 on axis 38 in the direction shown. As a person of skill in the art will appreciate the direction of motion is not considered critical to the therapeutic results of the circumduction provided by the present invention and, therefore, rotary element 16 of the present invention shall not be limited to rotation in one direction shown or the other direction. Accordingly, one embodiment of the present invention includes rotary element 16 being configured to rotate in both clockwise and counterclockwise directions because it is recognized that the effectiveness of the therapy may be increased when circumduction of the joint is performed in both directions. Therefore, it will be understood that the direction of the rotary element 16 may be clockwise, counter-clockwise, or intermittent combinations thereof and motor 18 is configured to provide such operation.

Figure 4:
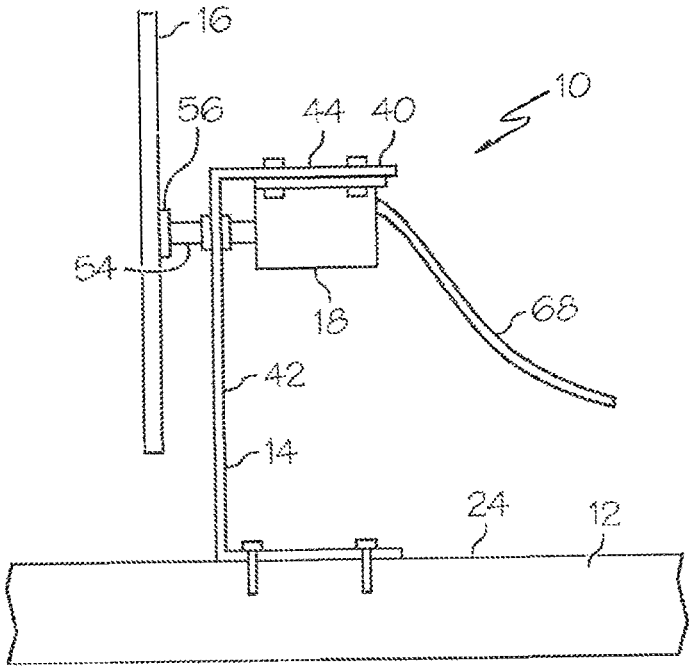
FIG. 4 is a side view of a continuous passive motion device in accordance with one embodiment of the present invention.

Motor 18 drives rotary element 16. Motor 18 may drive rotary element 16 using a mechanical transmission. FIGS. 1 and 5 illustrate an embodiment of a mechanical transmission including a first pulley 58 operably connected to a motor drive shaft 60, a second pulley 64 operably connected to axle 54 and/or rotary element 16, and a belt 62 that is drivingly engaged with both the first pulley 58 and second pulley 64. Second pulley 64 may be proximate second end 66 of axle 54 or located mid-length on axle 54 (shown in FIG. 1). First pulley 58 and second pulley 64 may include teeth. Similarly, belt 62 may have complimentary teeth or may be a chain configured to be complementary to teeth of pulleys 58 and 64. Another embodiment may include rotary element 16 being directly driven by the drive shaft 60 wherein drive shaft 60 is operably connected to vertical support 14 as shown in FIG. 4. Another embodiment (not shown) includes rotary element 16 or a direct gear drive from the motor shaft 60 to the rotary element 16 wherein motor 18 may be coupled to vertical support 14. Another embodiment (not shown) may include rotary element 16 being driven using a bevel gear assembly such that motor 18 and motor drive shaft 60 could be mounted in a direction substantially orthogonal to the rotary axis of circumduction. A person of skill in the art will recognize that there are many known methods of transferring rotary motion from motor drive shaft 60 to rotary element 16, all of which shall be within the scope of the present invention.

Motor 18 may be any motor type now known or hereafter developed including, alternating current electric motors, direct current electric motors, stepper motors, internal combustion, hydraulic, or other motor types now known or hereafter developed. The power source may be HOv or 220v commercially available electricity as common in the United States, commercially available electricity of voltages common in foreign countries, batteries, fuel cells, rechargeable batteries, solar generator, wind generator, or combination thereof. FIG. 1 illustrates an embodiment utilizing HOv common household electricity and power cord 68 supplying electricity to motor 18. Motor 18 may be a fixed-speed or variable-speed motor. Another embodiment may include an AC induction motor controlled by a variable speed drive as now known or hereafter developed. Motor 18 may be operable in two opposing rotational directions thereby providing circumduction in at least two directions. Motor 18 may act in concert with a timer providing circumduction for a desired amount of time, or be programmed for intermittent operation while the patient is sleeping. Motor 18 may further have electronic or computerized controls as now known or hereafter developed to simultaneously control operating parameters of the present invention including, but not limited to: motor on, motor off, and time intervals of same; motor speed; and direction of motor.

Motor 18 and the operation of continuous passive motion device 10 may also be controlled by a patient or operator using a wired or wireless remote, through the internet (wireless or wired), a smartphone, tablet computing device, an application for a smartphone or tablet, or otherwise controlled remotely by a computer through a network. Further, another embodiment may include security device such that some parameters of the operation and controls of continuous passive motion device 10 are exclusively adjusted or controlled by a physical therapist or physician.

One embodiment may include continuous passive motion device 10 having a computer or memory and processor connected to a private, public, or world-wide network. Such an embodiment may also include continuous passive motion device 10 recording and sending the operational parameters or a summary of each therapy session to a designated remote computer providing a physician or physical therapist access to in-home treatment data.

Motor 18 may be coupled directly to base 12 or may be coupled to base 12 using one or more motor brackets 70 as shown in FIG. 1. One embodiment of the present invention includes motor 18 being coupled to vertical support 14 as shown in FIG. 4. Another embodiment of continuous passive motion device 10 includes motor 18 being coupled to base 12 as shown in FIG. 5. Another embodiment of continuous passive motion device 10 includes motor 18 being coupled to housing 22 (not shown).

Figure 6:
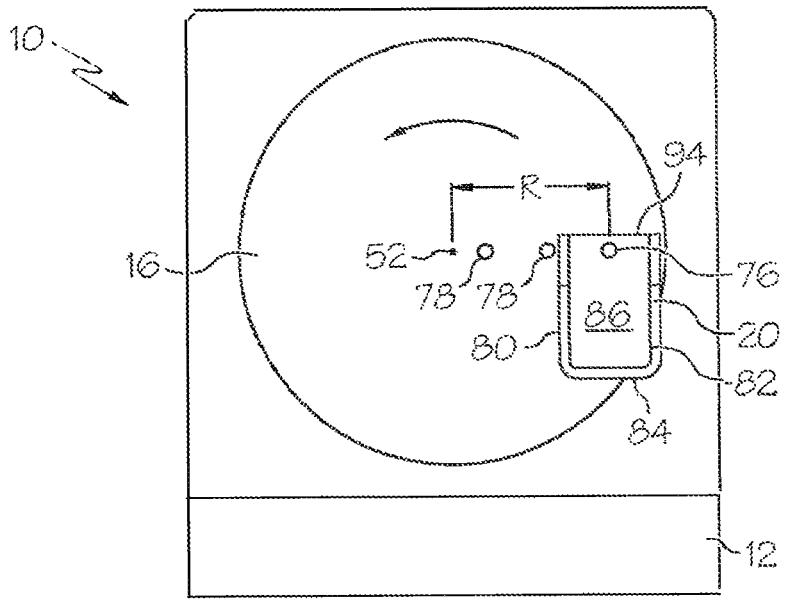
FIG. 6 is a front view of a continuous passive motion device in accordance with one embodiment of the present invention.

Limb support 20 generally supports a limb 72 of the patient receiving therapy with respect to the rotary element 16 such that continuous passive motion device 10 may in circumduction of the desired limb 72. Limb support 20 is generally operably connected to the rotary element 16 to provide a connection that secures limb support 20 to rotary element 16 in a horizontal and vertical direction, but allows limb support 20 to rotate in order to maintain limb 72 in a substantially vertical or otherwise neutral orientation when performing circumduction to reduce the likelihood of applying torque upon limb 72. An embodiment of limb support 20 shown in FIGS. 1-3, 5, and 6 includes a cradle type of limb support 20 wherein limb 72, in this case a foot, is supported both in a vertical and horizontal direction. As best shown in FIG. 6, a cradle-type limb support 20 may include a first sidewall 80, a second sidewall 82, a bottom 84, and a back 86. The bottom 84 may extend and be adjustable to support the lower leg extending to behind the knee. An embodiment of limb support 20 of the present invention may include straps 88 as shown in FIG. 3 to secure limb 72 within cradle 20. FIG. 1 illustrates an embodiment wherein limb support 20 is kept vertical using gravity wherein cradle 20 is journaled for rotation with respect to rotary element 16. FIG. 5 illustrates another embodiment wherein limb support 20 is kept vertical through a system of gears 90 driven by at least one belt or chain 92 that keeps the vertical orientation of cradle 20 fixed through the circumduction motion.

As shown in FIGS. 1 and 6, an embodiment of the present invention may include limb support 20 being operably connected to rotary element 16 with a circular rod 76 extending outwardly from back 86 wherein rod 76 is received in to an aperture through rotary element 16. Rod 76 is shown centered on back 86 proximate a top 94 of back 86. This connection could be permanent wherein limb support member 20 is fixedly connected to rotary element 16, or limb support member 20 may be removably attached allowing a patient to secure limb support member 20 to limb 72 prior to operably connecting limb support member 20 to rotary element 16. In one embodiment, limb support member 20 is released from rotary element 16 using a remote control operating an electronic or magnetic attachment mechanism. A person of skill in the art will recognize many connectors 74 and other connection types known or hereafter developed to fix a connected element with respect to linear translation, but provide for rotation of the attached member; therefore, connection types now known or hereafter developed that perform in these functions shall be within the scope of the present invention.

The connection of limb support 20 to rotary element 16 may be configured such that the radius of circumduction is fixed or variable. FIG. 6 illustrates an embodiment of the present invention wherein rod 76 of limb support 20 may be inserted in to one of three apertures 78 in rotary element 16, each aperture 78 corresponding to a different radius R. Another embodiment includes a slide-adjustment mechanism (not shown) as known in the art to allow limb support 20 to be positioned at a plurality of locations having a varied radius R. Radius R of one embodiment of the present invention may range from about one (1) inch to about fourteen (14) inches.

An embodiment of limb support 20 may include cushioning or padding (not shown) on sides 80, 82, bottom 84, back 86, or any combination thereof. Cushioning or padding may be solid foam, down, beads or particles, elastomeric materials, gels, rubber, or any other cushioning material now known or hereafter developed. An alternative embodiment includes cushioning being provided by inflatable members (not shown) that form around and substantially surround limb 72 when inflated to a pressure in order to provide a secure, but comfortable cushioning effect. Inflatable member may be in fluid communication with an air compressor. One embodiment includes continuous motion device 10 configured to self-inflate the inflatable cushions upon commencement of operation of the device 10, stop inflation using a pressure switch when a desire pressure is met, and deflate the cushions when the therapy is complete. Inflation of inflatable cushions may be incorporated into the operation of the device 10 as a separate step having individual and/or customizable controls, or may be automatic upon commencement of the circumduction therapy. Further, inflation, deflation and/or variations in pressurization of an inflatable cushion may be performed intermittently during circumduction therapy to circulate blood through the foot or leg, with one purpose being to attempt to prevent blood clots from forming.

Figure 7:
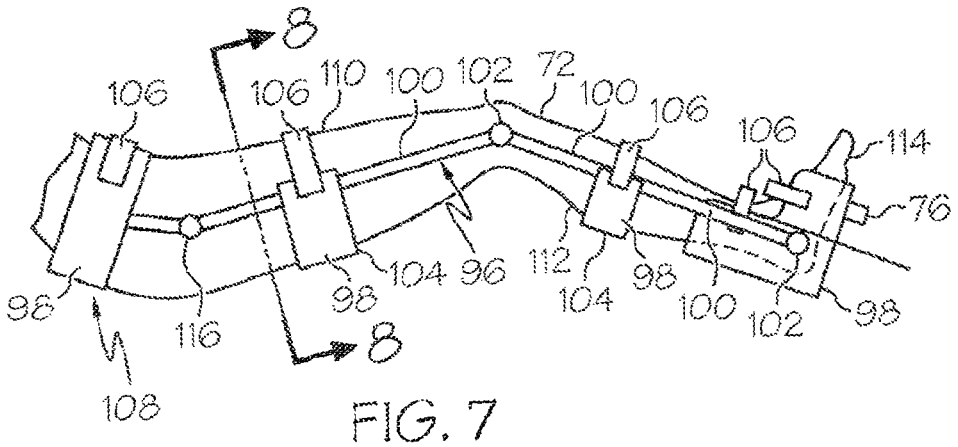
FIG. 7 is a side view of a limb support member coupled to a limb in accordance with one embodiment of the present invention.

An alternative embodiment of limb support 20 includes brace 96 that operably connects to rotary element 16 as shown in FIG. 7. Brace 96 may be a stand alone brace that is used to reinforce a joint during the recovery process, worn by a patient substantially at all times, and is configured to engage for use with continuous passive motion device 10 when therapy is desired. Alternatively, brace 96 may be secured to limb 72 and worn and used solely during treatment.

Brace 96 generally includes a plurality of securing members 98 that secure brace 96 to limb 72, in this case a leg as shown in FIG. 7, and a plurality of bars 100 spanning between securing members 98 and operably connected at joints 102. One embodiment of securing member 98 includes a rigid or semi-rigid support member 104 wherein leg 72 is secured within support member 104 using a strap 106. Rigid bar 100 may be a plate, tube, pipe, or other suitable shape known in the art. Joints 102 may be pivot or ball joints, or any combination thereof. A person of skill in the art will recognize that joints 102 used in braces are well known in the art and all joint types now known or hereafter developed are within the scope of the present invention. Further, the joint 116 closest to the patient's hip may be a ball joint or other known joint that allows the multi-directional rotation necessary to allow the circumduction of limb 72. Rigid or semi-rigid support member 104 is generally curved or can be formed into a curve in order to receive and conform generally to the shape of the body part secured. Rigid or semi-rigid brace members 100 and 106 may be any material known in the art including plastic, metal, wood, carbon-fiber composite, or other known composites and can be extruded, machined, molded, formed, pressed, or bent to a desired shape.

One embodiment of brace 96 is secured around a patient's waist 108 and extends substantially to patient's thigh 110, calf 112, or foot 114 to provide support and reinforcement of patient's hip joint as shown in FIG. 7. Another embodiment of brace 96 commences at patient's thigh 110 and extends to patient's calf 112 or foot 114. A further embodiment includes only securing member 98 around patient's thigh 110.

Figure 8:
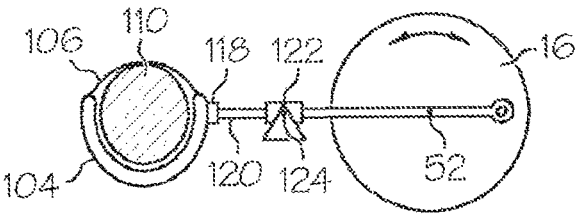

FIG. 7 illustrates an embodiment of the present invention wherein support member 10 supporting foot 114 would be operably connected to rotary member 16 in a manner similar to how support 20 is connected to rotary member 16 by rod 76 as described above. The embodiment shown in FIG. 8 includes an alternative embodiment of the present invention wherein rotary element 16 is connected to a patient's thigh 110 in order effectuate circumduction of the hip joint. In this embodiment a rotary connection member 118 is operably connected to rigid or semi-rigid support member 104. This connection may alternatively be rigid as opposed to allow for rotation. The connection between rotary member 118 and rotary element 16 may be accomplished through one or more links 120, one or more sliding connections 122, and one or more pivot joints 124 or any combination thereof as known in the art Support 104 at foot 114 may use a connection member 118 and linkage assembly like that shown in FIG. 8 to connect foot support 104 to rotary member 16.

Another embodiment of the continuous passive motion device 10 of the present invention is shown in FIG. 9. The vertical support comprises a first substantially vertical panel 150 including a top 162, a second substantially vertical panel 152 including a top 164, and a substantially horizontal spacer 154 coupled to the first vertical panel 150 and the second vertical panel 152 in a mid-portion of both panels thereby creating a frame. A first bearing 156 is coupled to top 162 of first vertical panel 150 and a second bearing 158 is coupled to top 164 of second vertical panel 152. Axle 54 spans between first bearing 156 and second bearing 158 and is journaled for rotation in each bearing 156 and 158. Axle 54 is operably coupled to rotary element 16 wherein rotary element 16 is a rigid bar extending outward from point of rotation 52. Limb support 20 is operably coupled to limb support 20 which may be a boot as shown. Axle 54 is driven by motor 18 through a mechanical transmission similar to that described above. Further, a remote control 160 is in electronic communication with motor 18 to control the operational parameters of the motor. Remote control 160 may be a wireless or wired as shown.

Figure 10:
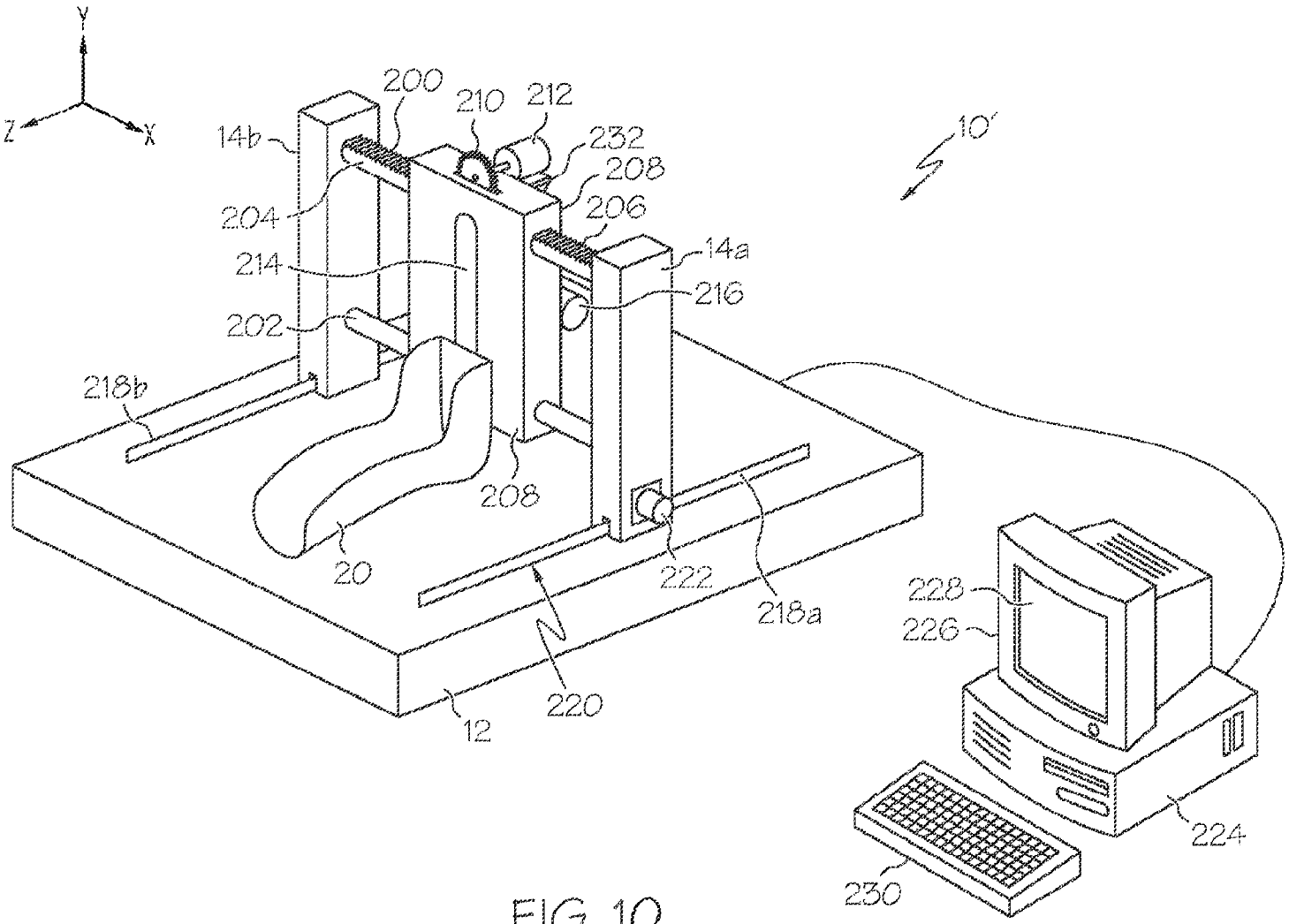
FIG. 10 is a top perspective view of a continuous passive motion device in accordance with one embodiment of the present invention.

Another embodiment of the continuous passive motion device 10' of the present invention is shown in FIG. 10. This embodiment includes at least two motorized linear stages which are controlled using a computer or like device. The computer controls the stages to move individually or in concert. The movement of the stages facilitates movement of limb 72 in a plurality of directions and patterns. A first linear stage 200 is coupled to or incorporated into vertical support members 14*a* and 14*b* as shown in FIG. 10. First linear stage 200 may comprise a bottom guide bar 202 and a top guide bar 204, Bottom guide bar 202 and top guide bar 204 are operably coupled to a second stage 208. Top guide bar includes a linear rack 206 integral with top guide bar or attached thereto A pinion gear 210 is configured with teeth that are complementary to teeth in linear rack 206. First linear stage member may include a first stage motor 212 drivingly engaged with pinion gear 210 and configured to selectively turn pinion gear 210 in two directions. First stage motor 212 may be coupled to second stage 208 as shown using a bracket 232. Thus, when first stage motor 212 is turned on, pinion gear 210 drivingly engages rack 206 to cause linear translation of second stage 208 in the positive or negative "x" direction relative to the bottom and top guide bars 202 and 204. The first stage is thus generally configured to move the second stage in the positive or negative "x" direction. The "x" direction can also be considered a first path. Second stage 208, moveable along a first path by first stage 200, is generally coupled to limb support member 20. Second stage 208 is configured to move limb support member 20 in the substantially linear negative and positive "y" direction as shown by a second stage motor 216 that may be included in second stage 208. The "y" direction can also be considered a second path. Limb support 20 is operably coupled to second stage 208 and may be configured to travel within slot 214. The mechanics of second stage 208 are not shown as they are contained within second stage 208; however, for all stages used in this embodiment, any linear stage configuration now known or hereafter developed could be used to provide linear motion including linear stages having the following types of guide systems: ball bearing, recirculating ball bearing, crossed roller bearing, flexure, cylindrical sleeve (first stage 200 as shown in FIG. 10) and/or dovetail. Further, any propulsion or transmission method now known or hereafter developed to cause the linear motion of a stage from the rotational drive of a motor is within the scope of the present invention, including: gears, belts, screw-drive, pulleys, hydraulics, or combinations thereof. Thus, any propulsion method may be combined with any guide system subject to limitations known in the art to result in the substantially linear motion of each stage.

Figure 11:
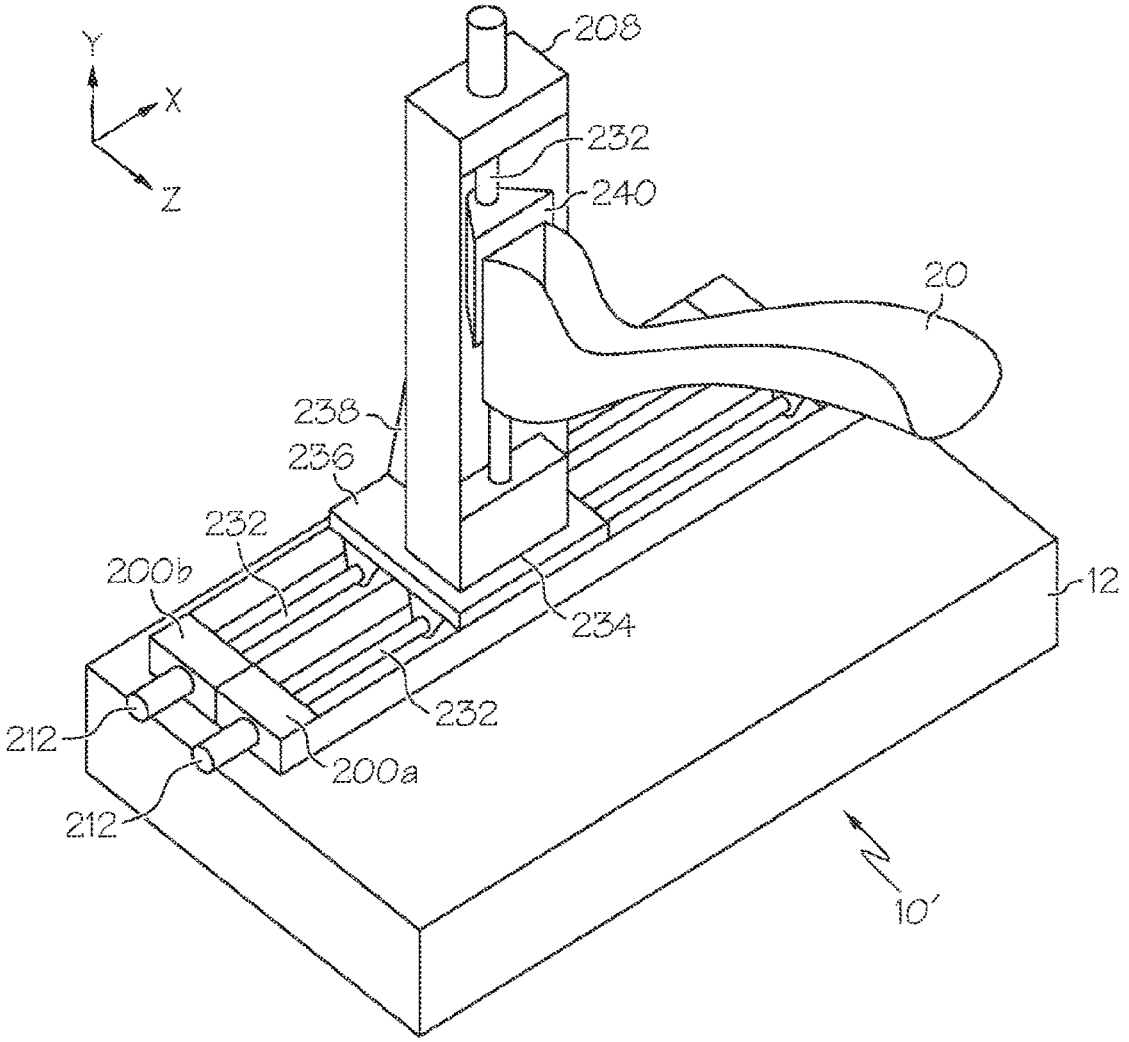
FIG. 11 is a top perspective view of a continuous passive motion device in accordance with one embodiment of the present invention.

Another embodiment of continuous passive motion device 10' includes first linear stage 200 having the guide system of at least one first linear stage 200 being coupled directly to top 24 of base 12. The embodiment shown in FIG. 11 includes two first linear stages 200*a* and 200*b*, with each stage having a moveable connection plate (hidden) on a guide 232 wherein the connection plate is moveable in the positive and negative "x" direction. The connection plate of first linear stage 200 is moveable along at least one guide 232 using a first stage motor 212. Further, a first end 234 of second linear stage 208 is mounted to plate 236 and the connection may be strengthened by stiffener 238. Plate 236 is coupled to the moveable connection plate of first linear stage 200*a* and 200*bb*. First stages 200*a* and 200*b* act in concert to move second stage 208 in a substantially linear positive and negative "x" direction. As shown, limb support 20 is coupled to a moveable plate 240 on at least one guide 232 on second stage 208 and second stage 208 is configured to move plate 240 and limb support 20 in a substantially linear positive and negative "y" direction which is substantially perpendicular to said "x" direction.

As shown in FIG. 10, continuous passive motion device 10' may also include a third stage 220 operable to move both first stage 200 and second stage 208 in the positive and negative substantially linear "z" direction as shown in FIG. 10. The "z" direction can be considered a third path. One embodiment includes vertical supports 14*a* and 14*b* moveable on third stage 220 along rails 218*a* and 218*b*. Another embodiment includes third stage 220 coupled to top 24 of base 12 and first stage 200 being operably coupled to third stage 220. Third stage motor 222 is operably integrated into third stage 220 such that operation of third stage motor 222 results in first stage 200 and second stage 208 being moveable in a substantially linear positive and negative "z" direction as shown in FIG. 10.

First stage 200, second stage 208, and/or third stage 220 may be operated by stage motors 212, 216, or 222. One or more stage motors 212, 216, or 222 may be in electronic communication with a controller 224. Controller 224 may be a computer as shown in FIG. 10, or may be any other processor and/or programmable controller known or hereafter developed. Controller 224 generally includes a user interface 6 that, in this case, comprises a viewable screen 228 and a keyboard 230. However, user interface 226 may comprise an interactive touch screen, a remote control, a smart phone, or any other known interface between users and electronic devices.

One desirable feature of the embodiment of continuous passive motion device 10' is that the motors of each stage may be in electronic communication with a controller that can be programmed to result in a multitude of movement patterns and speeds specifically targeted for rehabilitation of various limbs or joints. For example, motor 212 of first stage 200 and motor 216 of second stage 208 may be selectively operated by controller 224 to move in concert to cause movement of limb 72 within limb support member in a substantially circular motion in the x-y plane providing a pure circumduction motion. In addition, the controller 224 may be programmed to selectively operate motors to obtain any number of patterned motions, for example: figure eight in a horizontal or vertical orientation, a box-shape, diagonal, triangular, a clover leaf, or any combination of linear or curve-linear motion in the x-y plane. Further, controller 224 may selectively operate motor 222 of third stage 220 to cause substantially linear motion of first stage 200 and second stage 208 in the "z" direction. In this manner, a user may program or otherwise engage controller 224 to incorporate flexion of the joint or limb into the course of treatment. Controller 224, keyboard 230, and interface 226 may be integrated into the base 12.

An embodiment of the continuous passive motion device 10 of the present invention may be configured so as to also include one or more of the following operational features: quiet operation; the ability to place the circumduction machine on a bed during operation so that the device stays on a bed for treatments; lightweight so that it can be moved easily by one person; having a timer on the motor operation so that the device could turn off after a prescribed treatment period or so that the device can turn on or off over a period of time; a loading/vibrating feature; a Rapid Eye Movement ("REM") sleep detection system and active adjustment so the machine can vary the intensity of the circumduction based on your sleep status. Further, an embodiment of the present invention may be combined with motion in a flexion and extension of the hip joint simultaneously with the circumduction.

A person of skill in the art will recognize that principles of the present invention may be applied to the therapy of a number of joints including the hip, shoulder, elbow, wrist, knee, ankle, and other body parts such as the back, neck and torso, or other areas of the body.

From the foregoing, it may be seen that the continuous passive motion device of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense.

What is claimed is:

1. A device for circumduction of a limb comprising:

a base;

a vertical support operably coupled to and extending away from said base; a rotary member operably connected to said vertical support;

a motor drivingly engaged with said rotary member, said motor operable to cause rotation of said rotary member; and a limb support member operably connected to said rotary member;

wherein said vertical support is coupled to said base by one or more adjustment arms;

wherein said one or more adjustment arms are configured to slide along a length of said base;

wherein said vertical support adjustably coupled to said one or more adjustment arms is configured to fix said vertical support at one or more angular orientations relative to said adjustment arm.

2. The device of claim 1 wherein said rotary member includes a plurality of locations configured to receive said limb support, said plurality of locations defining one or more radial distances from a point of rotation of said rotary member.

3. The device of claim 2 wherein said plurality of locations comprises at least two holes through said rotary member, and wherein said limb support member includes a back and a rod coupled to said back, and wherein said holes are configured to receive said rod of said limb support member.

4. The device of claim 1 wherein said rotary member is operably connected to an axle that is operably coupled to said vertical support, wherein said rotary member and said axle are configured for rotation about a longitudinal axis of said axle.

5. The device of claim 4 wherein said motor applies torque directly to said axle.

6. The device of claim 5 further comprising a mechanical transmission that transfers torque from said motor to said axle.

7. The device of claim 1 wherein said limb support member is removably coupled to said rotary member.

8. The device of claim 1 wherein said limb support is a cradle-type support comprising a first sidewall, a second sidewall, a bottom spanning between said first sidewall and said second sidewall to form a U-shape, and a back coupled to at least said first sidewall and said second sidewall.

9. The device of claim 1 wherein said limb support member is configured to maintain said limb in a neutral position thereby not applying torque to said limb.

10. The device of claim 1 wherein said vertical support is a solid panel.

11. The device of claim 1 wherein said vertical support is a frame comprised of at least one substantially vertical member and at least one substantially horizontal member.

12. The device of claim 1 wherein said rotary member is a substantially circular disc coupled to an axle at a point of rotation, wherein said point of rotation substantially corresponds to a center of said disc.

* * * * *